US008430136B2

(12) United States Patent
Brasher

(10) Patent No.: US 8,430,136 B2
(45) Date of Patent: Apr. 30, 2013

(54) OIL CATCH TRAY FOR LOAD TAP CHANGER TANK

(75) Inventor: Jon C. Brasher, Medina, TN (US)

(73) Assignee: ABB Technology AG, Zurich (CH)

( * ) Notice: Subject to any disclaimer, the term of this patent is extended or adjusted under 35 U.S.C. 154(b) by 146 days.

(21) Appl. No.: 13/040,007

(22) Filed: Mar. 3, 2011

(65) Prior Publication Data

US 2012/0222988 A1 Sep. 6, 2012

(51) Int. Cl.
*B65B 1/04* (2006.01)
*B65B 3/04* (2006.01)

(52) U.S. Cl.
USPC ..... 141/86; 137/312; 137/313; 222/108

(58) Field of Classification Search ..... 141/86; 137/312–314; 222/108, 192; 206/557; 220/729
See application file for complete search history.

(56) References Cited

U.S. PATENT DOCUMENTS

| | | | | |
|---|---|---|---|---|
| 3,596,591 | A * | 8/1971 | Spates | 99/392 |
| 4,802,514 | A * | 2/1989 | Morse | 141/86 |
| 4,802,599 | A * | 2/1989 | Hill | 220/573 |
| 5,339,676 | A * | 8/1994 | Johnson | 73/40 |
| 5,482,093 | A * | 1/1996 | Tremonti et al. | 141/98 |
| 5,715,876 | A * | 2/1998 | Burt | 141/86 |
| 5,967,200 | A * | 10/1999 | Hall | 141/86 |
| 6,102,086 | A * | 8/2000 | Holtby | 141/86 |
| 7,921,884 | B2 * | 4/2011 | Brewer et al. | 141/86 |
| 8,002,146 | B2 * | 8/2011 | Cahen et al. | 222/108 |
| 8,152,024 | B2 * | 4/2012 | Njaastad et al. | 222/108 |
| 8,172,111 | B1 * | 5/2012 | Fowler et al. | 222/108 |
| 2009/0025704 | A1 * | 1/2009 | Padula | 126/21 A |

FOREIGN PATENT DOCUMENTS

| | | |
|---|---|---|
| DE | 912366 C | 5/1954 |
| FR | 745500 A | 5/1933 |
| GB | 464525 A | 4/1937 |

OTHER PUBLICATIONS

PCT Search Report & Written Opinion in PCT/US12/025835 mailed on Jun. 14, 2012.

* cited by examiner

*Primary Examiner* — Timothy L Maust
*Assistant Examiner* — Robert Bell, III
(74) *Attorney, Agent, or Firm* — Manelli Selter PLLC; Edward J. Stemberger

(57) ABSTRACT

A tank for a load tap changer includes opposing front and rear walls, opposing side walls, and a bottom wall joined to define a box-like structure. A door structure is removably coupled to one of the walls. An oil catch tray is coupled to the tank and is movable between a retracted, storage position generally adjacent to the bottom of the tank, and an operative position extending outwardly from the one wall to which the door structure is coupled and generally under a portion of the door structure. In the operative position, the oil catch tray is constructed and arranged to collect oil that drips from the door structure and the one wall when the door structure is removed from the one wall.

16 Claims, 3 Drawing Sheets

OIL CATCH TRAY FOR LOAD TAP CHANGER TANK

BACKGROUND OF THE INVENTION

The present invention relates to load tap changers and, more particularly, to an oil catch tray for collecting residual oil that may drain from the load tap changer tank upon opening an inspection door.

A load tap changer switches connections between taps of windings of a transformer while the transformer is connected to the voltage source. Components of the tap changer are housed in an oil-filled tank so as to suppress arcing. The oil-filled tank typically has a side mounted inspection door. When the oil-filled tank is drained, some residual oil remains trapped by gaskets and/or gasket stop associated with the door. When the door is opened, this trapped oil can fall to the ground which can lead to environmental and safety issues.

Thus, there is a need to provide an oil tank for a load tap changer that can catch residual oil when an inspection door of the tank is opened.

SUMMARY OF THE INVENTION

An objective of the present invention is to fulfill the need referred to above. In accordance with the principles of the invention, this objective is obtained by providing a tank for a load tap changer. The tank includes opposing front and rear walls, opposing side walls, and a bottom wall joined to define a box-like structure. Door structure is removably coupled to one of the walls. An oil catch tray is coupled to the tank and is movable between a retracted, storage position generally adjacent to the bottom of the tank, and an operative position extending outwardly from the one wall to which the door structure is coupled and generally under a portion of the door structure. In the operative position, the oil catch tray is constructed and arranged to collect oil that drips from the door structure and the one wall when the door structure is removed from the one wall.

In accordance with another aspect of the invention, an oil catch tray for a tap changer oil tank includes a pair of opposing end walls, a pair of elongated, opposing side walls, and a bottom wall defining an oil contacting surface. Each end wall includes a though-hole such that the oil catch tray can be pivotally coupled with the oil tank, via the through-holes, so as to be movable between a storage position and an operative, oil catching position.

In accordance with yet another aspect of the invention, a method is provided for catching oil that may drip from an load tap changer oil tank when a door structure thereof is removed. The method provides an oil catch tray pivotally coupled to the oil tank. The oil catch tray is moved from a retracted, storage position to an operative position extending from a wall of the tank to which the door structure is coupled and generally under a portion of the door structure. When the door structure is removed from the wall, the oil catch tray collects oil that may drip from the door structure and the wall.

Other objectives, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF AN EXAMPLE EMBODIMENT

Figure 1:
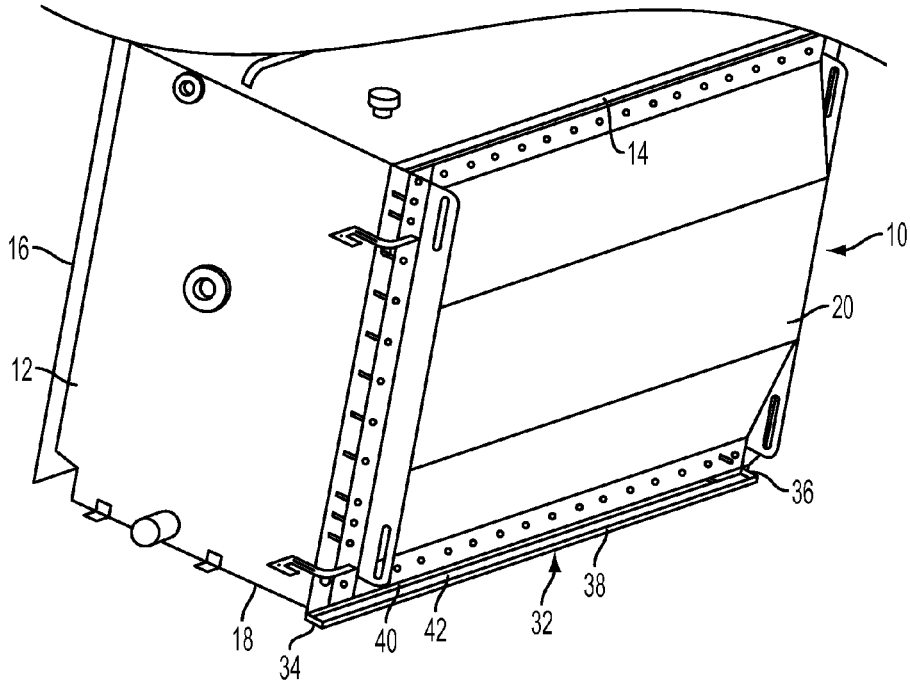
FIG. 1 is a front perspective view of an oil tank of a load tap changer shown with a front door structure thereof being removed and with an oil catch tray, in accordance with and embodiment, in an operative position to catch residual oil.
Figure 2:
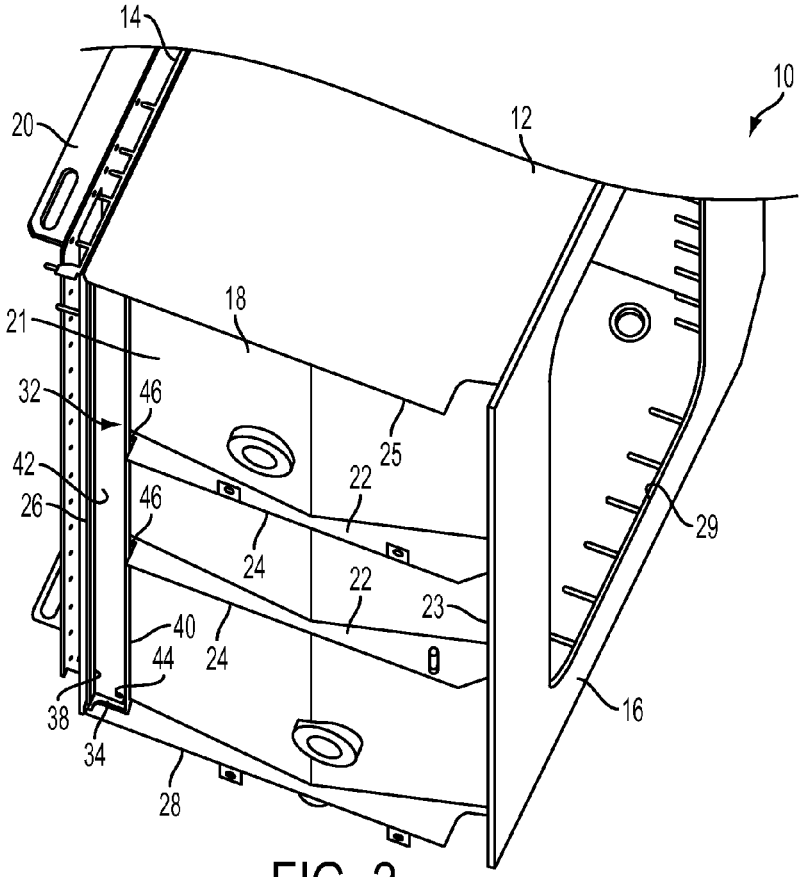
FIG. 2 is a bottom perspective view of the oil tank with oil catch tray of FIG. 1 shown with the oil catch tray in a retracted, storage position.

With reference to FIG. 1, a tank for a load tap changer is shown, generally indicated at 10, in accordance with an embodiment of the invention. The tank 10 is a box-shaped structure having opposing side walls 12, a front wall 14, an opposing rear wall 16 and a bottom wall 18. A removable inspection door structure 20 is coupled to one of the walls. In the embodiment, the inspection door structure 20 is mounted in a sealing relation with the front wall 14 via gaskets and gasket stop which are considered to be part of the door structure 20. As shown in FIG. 2, the side walls, front and rear walls extend beyond a bottom wall 18 of the tank 10 to define an interior space 21. Support ribs 22 are coupled to the bottom wall 18 and extend between the walls 14 and 16. Each support rib has an edge 24. In addition, the side walls and front and rear walls define edges 23, 25, 26 and 28 so that the tank 10 can rest on these edges and/or on the edges 24 of support ribs 22 while in the factory and during shipping.

The door structure 20 is shown being initially removed from the front wall 14 in FIGS. 1 and 2. It is noted that the bus bar backboard is not shown in FIG. 2, which is normally coupled to the rear wall 16 of the tank 10 so as to cover opening 29. As noted above, when the oil from the tank 10 is drained, residual oil may remain in gaskets and/or gasket stop of the door structure 20.

Figure 3:
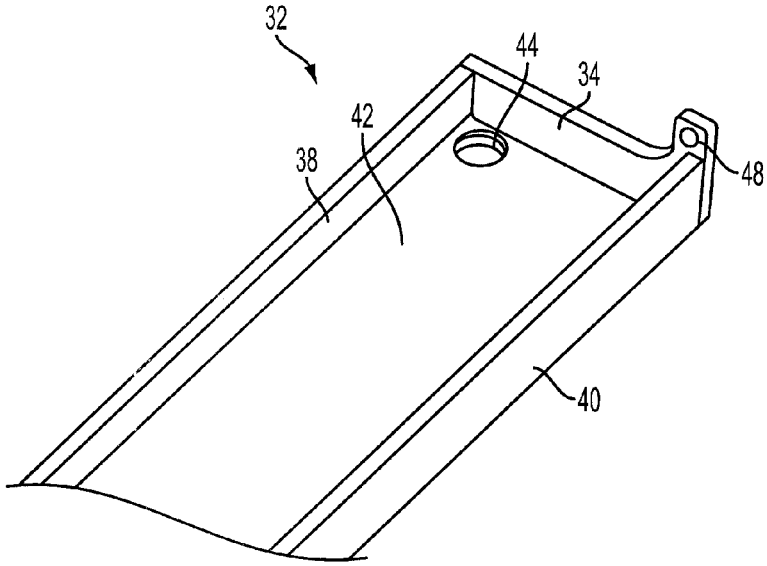
FIG. 3 is an enlarged view of an end of the oil catch tray of the embodiment.

Thus, in accordance with an embodiment, the tank 10 includes an oil catch tray, generally indicated at 32, constructed and arranged to extend outwardly from the front wall 14 and generally under a portion of the door structure 20. Thus, the oil catch tray 32 is in position (FIG. 5) to catch residual oil that may drip when the door structure 20 and front wall when the door structure 20 is removed from front wall 14 of the tank 10. The tray 32 is shown in an extended, operative position in FIGS. 1 and 5 and extends substantially the entire length of the front wall 14. With reference to FIGS. 1 and 3, the tray 32 includes a pair of opposing end walls 34, 36, a pair of elongated, opposing side walls 38, 40 and a bottom wall 42 defining an oil contacting surface, so that any oil entering the tray 32 via the open top is captured by the end walls, side walls and bottom wall. The oil contacting surface 42 tapers towards a drain plug opening 44 near an end wall (e.g., wall 34) so that oil may drain via gravity through the opening 44 when unplugged. A conventional threaded ¼" half pipe coupling (not shown) can be welded to the bottom wall over the opening 44 to allow the user to easily attach other pipe fittings thereto so as to route the oil and mitigate the amount of accidental spills that may occur when using a drain plug.

Figure 4:
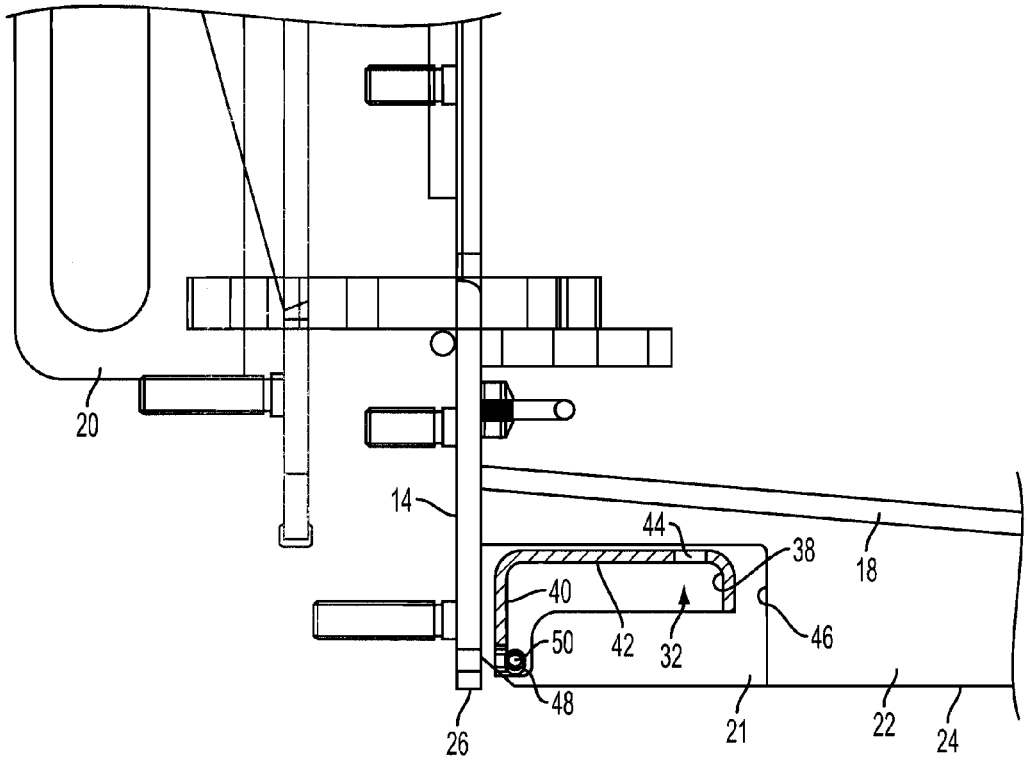
FIG. 4 is a partial end view of the oil tank of FIG. 1, shown with the oil catch tray in the retracted, storage position.
Figure 5:
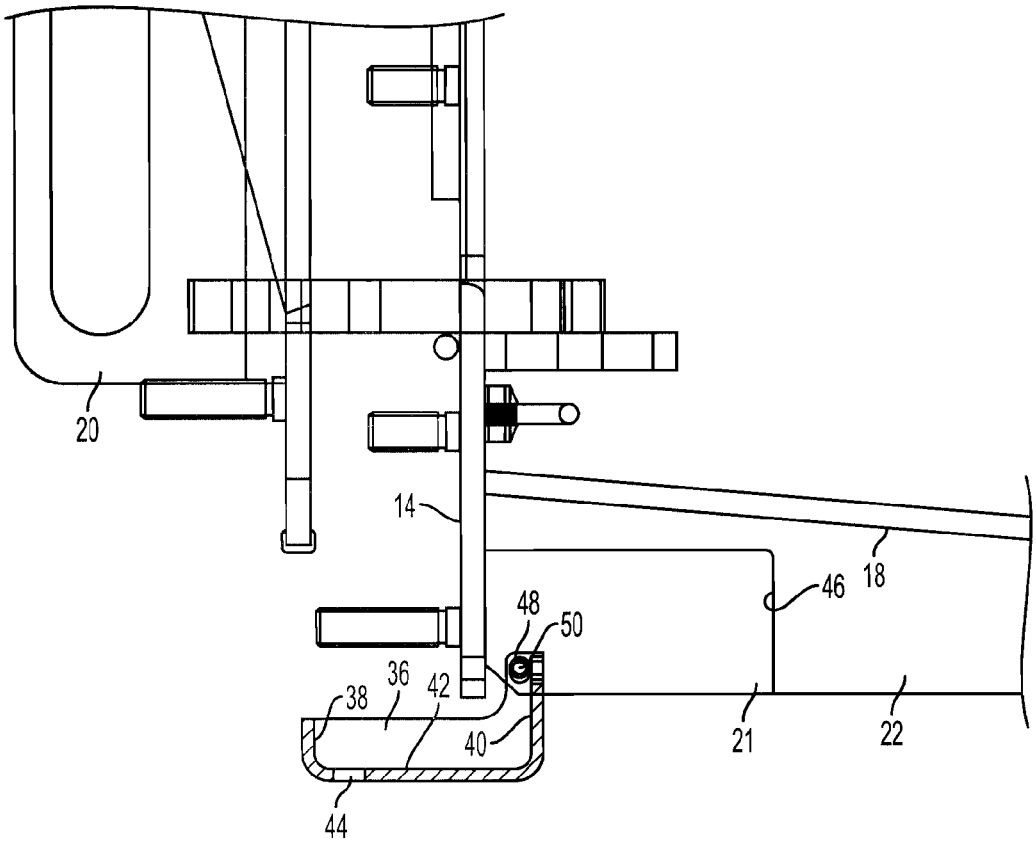
FIG. 5 is a partial end view of the oil tank of FIG. 1, shown with the oil catch tray in the operative, extended position.

With reference to FIGS. 2 and 4, the tray 32 is manually fully retractable under the tank 10 entirely within space 21 so as to be generally adjacent to the bottom wall 18. Thus, when the tray 32 is not needed, rain or other debris will not collect in the tray 32. As shown in FIG. 2, to accommodate the tray 10 in the retracted, storage position, each support rib 22 includes notch 46 in an end thereof near the front wall 14. Thus, when the tray 10 is in the retracted position, the tank 10 can still be supported by the edges 23, 25, 26 and 28 of the walls and/or by the edges 24 of the support ribs 22 as explained above. In the embodiment, the tray is manually pivoted from the retraced position (FIGS. 2 and 4) to the extended, operative position (FIGS. 1 and 5). To permit the pivoting of the tray 10 between the storage and operative positions, each end wall 34 and 36 of the tray 10 includes a though-hole 48 that receives a shoulder bolt 50 (FIG. 4) that is coupled to the tank 10. Thus, the tray is can pivot 180°. The holes 48 are preferably eccentric to allow for the oil to drain down to one side of the tray 10.

Figure 6:
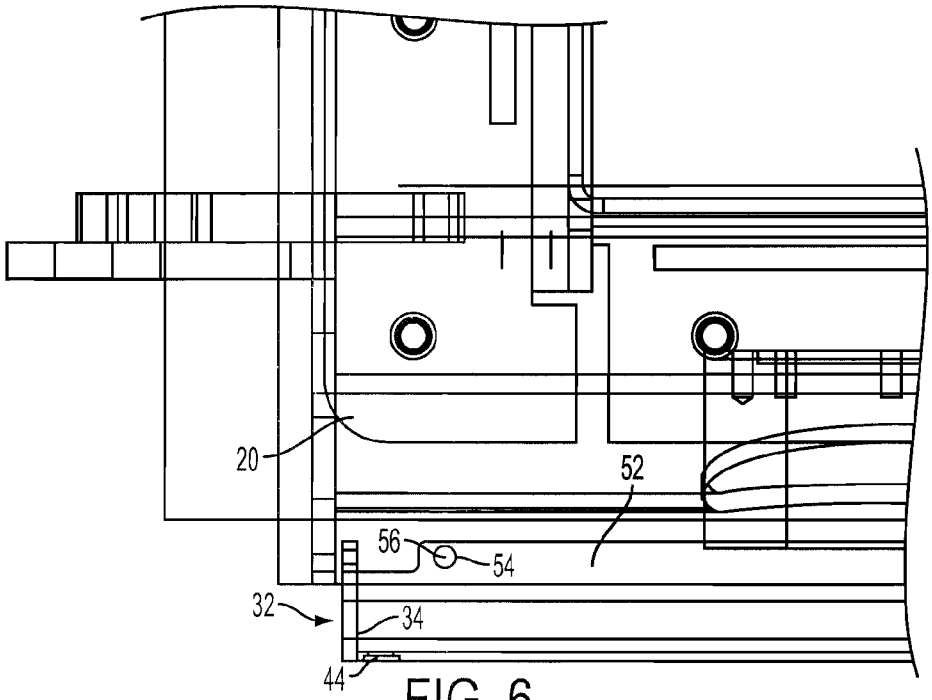
FIG. 6 is a partial front view of a tab locking feature of the oil catch tray of an embodiment.

With reference to FIGS. 6 and 7, in order to keep the tray 10 in place in either the retracted or extended positions thereof, a tab 52 having a through-hole 54 is provided on the tray 10 perpendicular to the pivot axis of the tray 10. A pin 36 can be inserted through the hole 54 and into a hole provided in the tank to lock the tray 10.

Thus, it can be seen that the oil catch tray 10 provides an effective means for collecting residual oil that may drip from the tray 10 when the door structure 20 is opened or removed.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A tank for a load tap changer, the tank comprising:

opposing front and rear walls, opposing side walls, and a bottom wall joined to define a box-like structure constructed and arranged to house the load tap changer, door structure removably coupled to one of the walls, and an oil catch tray coupled to the tank and entirely movable between a retracted, storage position adjacent to the bottom of the tank and an operative position extending outwardly from the one wall to which the door structure is coupled and under a portion of the door structure, wherein, in the operative position, the oil catch tray is constructed and arranged to capture oil that drips from the door structure and the one wall when the door structure is removed from the one wall.

2. The tank of claim 1, wherein the side walls and the front and rear walls extend beyond the bottom wall to define an interior space, the tank further including support ribs coupled to the bottom wall and extending substantially between the front and rear walls, the tank being constructed and arranged to be supported on a surface by edges of the support ribs and/or the edges of the side walls and front and rear walls.

3. The tank of claim 2, the door structure is coupled to the front wall, and wherein each support rib includes a notch therein at an end thereof near the front wall, the notches receiving a portion of the oil catch tray when in the retracted, storage position thereof, the oil catch tray, in the retracted, storage position, being disposed entirely within the interior space.

4. The tank of claim 1, wherein the oil catch tray includes a pair of opposing end walls, a pair of opposing side walls and a bottom wall defining an oil contacting surface, so that any oil entering the oil catch tray is captured by the walls of the oil catch tray.

5. The tank of claim 4, wherein the oil contacting surface has a drain plug opening therein, the oil contacting surface tapers towards the drain plug opening so that oil may drain via gravity through the drain plug opening.

6. The tank of claim 5, wherein the drain plug opening is threaded so as to receive a threaded plug.

7. The tank of claim 4, wherein each end wall of the oil catch tray includes a though-hole that receives a shoulder bolt that is coupled to the tank so that the oil catch tray can pivot between the storage and operative positions.

8. The tank of claim 7, wherein the oil catch tray is constructed and arranged to pivot between 180°.

9. The tank of claim 7, wherein the through-holes are eccentric.

10. The tank of claim 1, wherein, in the operative position, the oil catch tray extends substantially an entire length of the one wall, near a bottom thereof.

11. The tank of claim 1, wherein the oil catch tray is constructed and arranged to be locked in either of the storage and operative positions.

12. The tank of claim 11, wherein the oil catch tray includes a tab having a through-hole such that a pin can be inserted through the through-hole of the tab and into a hole provided in the tank to lock the oil catch tray with respect to the tank.

13. A method of catching oil that may drip from a load tap changer oil tank when a door structure thereof is removed, the method comprising:

providing an oil catch tray pivotally coupled to the oil tank, the oil tank being constructed and arranged to house the load tap changer, moving the entire oil catch tray from a retracted, storage position to an operative position extending from a wall of the tank to which the door structure is coupled and generally under a portion of the door structure, and removing the door structure from the wall with the oil catch tray capturing oil that may drip from the door structure and the wall.

14. The method of claim 13, wherein the step of providing the oil catch tray includes providing a bottom surface of the oil catch tray with a drain plug opening therein, and ensures that the bottom surface tapers towards the drain plug opening so that oil may drain via gravity through the drain plug opening.

15. The method of claim 13, wherein the step of moving includes pivoting the oil catch tray between 180° from the storage position to the operative position.

16. The tank of claim 1, wherein the oil catch tray is constructed and arranged to pivot 180° between the storage and operative positions.

* * * * *